US005234788A

United States Patent [19]

Morimoto et al.

[11] Patent Number: 5,234,788

[45] Date of Patent: Aug. 10, 1993

[54] DEVELOPER COMPOSITION FOR ELECTROPHOTOGRAPHY

[75] Inventors: Eizi Morimoto; Kuniyasu Kawabe; Tetuhiro Semura, all of Wakayama, Japan

[73] Assignee: KAO Corporation, Tokyo, Japan

[21] Appl. No.: 814,628

[22] Filed: Dec. 30, 1991

[30] Foreign Application Priority Data

Jan. 18, 1991 [JP] Japan ..... 3-4414

[51] Int. Cl.[5] ..... G03G 9/087

[52] U.S. Cl. ..... 430/106.6; 430/109

[58] Field of Search ..... 430/106.6, 109, 110, 430/111

[56] References Cited

U.S. PATENT DOCUMENTS

| | | | |
|---|---|---|---|
| 2,297,691 | 10/1942 | Carlson | 430/56 |
| 4,863,824 | 9/1989 | Uchida et al. | 430/109 |
| 4,940,644 | 7/1990 | Matsubara et al. | 430/109 |
| 5,037,715 | 8/1991 | Hagiwara et al. | 430/109 |

FOREIGN PATENT DOCUMENTS

| | | |
|---|---|---|
| 3808448 | 9/1988 | Fed. Rep. of Germany . |
| 60-214368 | 10/1935 | Japan . |
| 4223910 | 11/1942 | Japan . |
| 4324748 | 10/1943 | Japan . |
| 57-109825 | 7/1982 | Japan . |
| 57-208559 | 12/1982 | Japan . |
| 58-11954 | 1/1983 | Japan . |
| 59-7960 | 1/1984 | Japan . |
| 59-9669 | 1/1984 | Japan . |
| 59-11902 | 1/1984 | Japan . |
| 59-29255 | 2/1984 | Japan . |
| 59-29256 | 2/1984 | Japan . |
| 59-29257 | 2/1984 | Japan . |
| 59-29258 | 2/1984 | Japan . |
| 59-228861 | 12/1984 | Japan . |
| 60-4947 | 1/1985 | Japan . |

OTHER PUBLICATIONS

Electrophotography: The Society Journal, vol. 22, No. 1, 1983, pp. 7–16.

Electrophotography: The Society Journal, vol. 25, No. 1, 1986, pp. 52–58.

*Primary Examiner*—John Goodrow

*Attorney, Agent, or Firm*—Birch, Stewart, Kolasch & Birch

[57] ABSTRACT

A developer composition for electrophotography comprising a binding resin and a colorant, said binding resin comprising a first linear polyester having a softening point, Tsp, in the range of from 105° C. to 170° C. exclusive, and a second linear polyester having a softening point, Tsp, in the range of from 80° C. to 105° C. exclusive and lower than that of the first linear polyester by at least 10° C., the weight ratio of the first linear polyester to the second linear polyester being (80:20) to (20:80) is disclosed.

The developer composition of the present invention is excellent in the hot offset resistance, low temperature fixation, smoothness of fixed face, blocking resistance and transparency.

8 Claims, No Drawings

DEVELOPER COMPOSITION FOR ELECTROPHOTOGRAPHY

FIELD OF THE INVENTION

The present invention relates to a developer composition for electrophotography suitable for use in a color developer of a full color copying machine for developing an electrostatic charge image in electrophotograph, electrostatic recording, electrostatic printing, etc.

DESCRIPTION OF THE RELATED ART

In electrophotography, many processes are known as described in U.S. Pat. No. 2,297,691 and Japanese Patent Publication Nos. 23910/1967 and 24748/1968. Among them , a general process comprises forming an electrical latent image on a photoreceptor by various means through the utilization of a photoconductive substance, developing the latent image with a toner, optionally transferring the resultant toner image to a transfer material, such as paper, and fixing the image by heat, pressure or solvent vapor to obtain a duplicate.

Various processes and apparatus have been developed regarding the above-described final step, i.e., the step of fixing a toner image on a sheet, such as paper. The process most commonly used in the art at the present time is a press bonding heating system.

In the press bonding heating system in which a heating roller is used, the fixation is conducted by passing a fixing sheet through a heating roller having a surface comprising a material which is releasable from a toner in such a manner that the toner image on the fixing sheet is brought into contact with the surface of the heating roller under pressure. In this process, since the surface of the heating roller is brought into contact with the toner image under pressure, the heat efficiency in the case where the toner image is fused to the fixing sheet is so good that the fixation can be rapidly conducted, which renders this process very useful in high-speed electrophotographic equipment. In the above-described process, however, since the surface of the heating roller comes into contact with the toner image in a molten state under pressure, part of the toner image adheres to and is transferred onto the surface of the fixing roller and re-transferred onto the next fixing sheet, so that there occurs the so-called "offset" phenomenon, which may stain the fixing sheet. The avoidance toner adhering onto the surface of the heat fixing roller is viewed as one requirement for the heat roller fixation system.

In other words, the development of a binder resin for a toner having a broad fixation temperature region and a higher offset resistance has been described in the art.

Two-color copying machines, and full color copying machines as well, have been studied, and many of them have been put to practical use. For example, there are reports on the color reproducibility and tone reproducibility in "Journal of the Society of the Electrophotography of Japan", vol. 22, No. 1 Page 7 (1983) and "Journal of the Society of the Electrophotography of Japan", vol. 25, No. 1, p. 52 (1986).

As opposed to television images, photographs and color prints, the full color electrophotographic image is not immediately compared with the original, and full color electrophotographic images, which have been put to practical use, are not always satisfactory for persons who get used to seeing a color image processed more beautifully than the original.

In full color electrophotography wherein development is conducted a plurality of times, and it is necessary to put several kinds of toner layers different from each other in color on an identical substrate, color toners used in such electrophotography should satisfy the following requirements.

(1) In order to avoid the inhibition of color reproducibility derived from the irregular reflection of light, the fixed toner should be placed in a substantially molten state such that the form of the toner particles cannot be distinguished.

(2) The color toner should be transparent to such an extent that the color reproducibility of the underlying layer having a different color toner is not inhibited.

Thus, the toner for a full color copying machine is required to not only have a broad fixation temperature region but also have transparency and flatness in the fixed face.

In order to broaden the fixation temperature region of the polyester, Japanese Patent Laid-Open Nos. 208559/1982, 11954/1983 and 228861/1984 each disclose a method in which an offset preventive agent is used. In these methods, however, the fluidity lowers, the toner impaction to the carrier is accelerated in a binary system, and the transparency is lost in the case of a full color toner. Japanese Patent Laid-Open Nos. 109825/1982 and 11902/1984 each discloses a method of improving the offset resistance through the use of a polycarboxylic acid to form a three-dimensional structure in the polyester. In these methods, although the offset resistance can be improved, when a large proportion is occupied by a high molecular region, the elasticity becomes very large when a toner is prepared therefrom, so that the fixed face does not become flat when the fixation is conducted at relative low temperature. This brings about a problem of color reproducibility when it is used in a full color toner. Further, Japanese Patent Laid-Open Nos. 7960/1984, 9669/1984 and 29255-29258/1984 each discloses a method of forming a three-dimensional structure in the polyester through the use of a tricarboxylic or higher polycarboxylic acid or a triol or a higher polyol. In the methods described in Japanese Patent Laid-Open Nos. 29255 and 29256/1984, however, the fixation is poor due to the absence of a soft segment, such as a succinic acid derivative. Further, in the methods described in Japanese Patent Laid-Open Nos. 7960/1984, 9669/1984, 29257/1984 and 29258/1984, since succinic acid substituted with an alkyl group is used, the toner exhibits fixation superior to that of the toners disclosed in Japanese Patent Laid-Open Nos. 29255 and 29256/1984 but is still unsatisfactory in fixation when it is used in a full color toner.

As described above, it is very difficult to simultaneously satisfy the broadening of the fixation temperature region and the toner properties, i.e., charging properties, fluidity, durability, transparency and smoothness of the fixed face.

SUMMARY OF THE INVENTION

An object of the present invention is to provide a novel developer composition for electrophotography which eliminated the above-described problems.

Another object of the present invention is to provide a developer composition for electrophotography comprising a toner for heat roller fixation capable of forming a smooth fixed face for the purpose of avoiding the inhibition of color reproduction derived from irregular reflection.

A further object of the present invention is to provide a developer composition for electrophotography comprising a toner for heat roller fixation which has excellent fluidity, no agglomeration and has excellent impact resistance.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present inventors have made intensive studies with a view toward attaining the above-described objects and, as a result, have completed the present invention.

Specifically, the present invention relates to a developer composition for electrophotography comprising a binding resin and a colorant, said binding resin comprising a first linear polyester having a softening point, Tsp, in the range of from 105° C. to 170° C. exclusive, and a second linear polyester having a softening point, Tsp, in the range of from 80° C. to 105° C. exclusive and lower than that of the first linear polyester by at least 10° C., the weight ratio of the first linear polyester to the second linear polyester being (80:20) to (20:80).

It is preferable that the first linear polyester and the second linear polyester each comprises an acid component originated from an aliphatic dicarboxylic acid and/or acid anhydride thereof in an amount of 50% or more by mole, based on the entire acid component.

It is preferable that the first linear polyester and the second linear polyester each comprises an alcohol component originated from a compound represented by the following general formula (1) as a main component of its alcohol component.

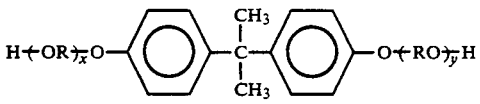

(1)

wherein R stands for an ethylene group or a propylene group and x and y are each an integer, provided that the average value of the sum of x and y values is 2 to 7.

Furthermore, it is preferable that the glass transition temperature of the first linear polyester and the second linear polyester each is 40° to 80° C.

The binding resin is preferably comprised °F. 70 to 100% by weight of the total amount of the first linear polyester and the second linear polyester, based on the entire binding resin.

The binding resin comprises more preferably 70 to 100% by weight of the total amount of the first linear polyester and the second linear polyester and 30 to 0% by weight of styrene-acrylic resin, based on the entire binding resin.

The developer composition of the present invention, preferably further comprises a low molecular weight polyolefin and/or a magnetic impalpable powder.

DETAILED DESCRIPTION OF THE INVENTION

The constitution of the present invention will now be described in detail. In the above-described first polyester, when the softening point, Tsp, is higher than the above-described range, the low-temperature fixation, the smoothness of the fixed face, the transparency and grindability become lower, while when the softening point, Tsp, is lower than the above-described range, the hot offset resistance and the blocking resistance become lower.

In the above-described second polyester, when the softening point, Tsp, is higher than the above-described range, the low-temperature fixation, the smoothness of the fixed face, the transparency and grindability become lower, while when the softening point, Tsp, is lower than the above-described range, the hot offset resistance and the blocking resistance become lower.

Basically, when the difference in the softening point, Tsp, between the above-described first polyester and the above-described second polyester contained in the developer composition of the present invention is 10° C. and more, the excellent properties of the individual polyesters are exhibited. On the other hand, when the difference in the softening point, Tsp, is less than 10° C., the expression of excellent properties of each of the first polyester and the second polyester are suppressed, such that some of the properties among those of hot offset resistance, low temperature fixation, transparency, smoothness of the fixed face and blocking resistance are adversely affected.

The blending weight ratio of the above-described first polyester to the above-described second polyester is (80:20) to (20:80), particularly preferably (70:30) to (30:70). When the blending weight ratio of the above-described first polyester is higher than the above-described range, the low temperature fixation and the smoothness of the fixed face are liable to be reduced. On the other hand, when the blending weight ratio of the first polyester is lower than the above-described range, the hot offset resistance and the blocking resistance are liable to be reduced.

Each of the above-described first polyester and the second polyester contains an acid component originated from an aliphatic dicarboxylic acid monomer which forms a relatively soft segment, preferably in an amount of 50% by mole or more based on the entire acid component. In this case, the low temperature fixation, the smoothness of the fixed face and the transparency become better.

It is preferred that the first polyester and the second polyester each further comprises an alcohol component originated from a diol represented by the following general formula (1) as a main alcohol component.

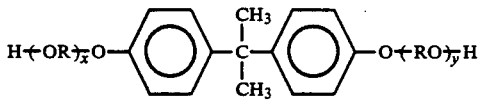

(1)

wherein R stands for an ethylene group or a propylene group and x and y are each an integer, provided that the average value of the sum of x and y values is 2 to 7.

The presence of the above-described alcohol component (the alcohol component originated from a diol represented by the general formula (1)) as the constituent unit contributes to a further improvement in the hot offset resistance, low temperature fixation and blocking resistance of the toner.

The glass transition point, Tg, of the first polyester and the second polyester each is preferably 40° to 80° C. A further improvement in the hot offset resistance, low temperature fixation and blocking resistance can be attained through the selection of the polyesters having a glass transition point falling within the above-described range. Specifically, when the glass transition point, Tg, is higher than the above-described range, the low temperature fixation and the smoothness of the fixed face are liable to be lower. On the other hand, when the glass transition point, Tg, is lower than the above-described range, the blocking resistance is liable to be lower.

In the present invention, the monomers used for the synthesis of the first polyester and the second polyester are basically the following dihydroxy alcohol or diol monomers and dicarboxylic acid monomers.

Examples of the dihydroxy alcohol monomer include etherified bisphenol, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

Among them, etherified bisphenol is particularly effective. Specific examples thereof include polyoxypropylene (2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene (2.0)-polyoxyethylene(2.0)-2,2-bis(4-hydroxyphenyl)propane and polyoxypropylene(6)-2,2-bis(4-hydroxyphenyl)propane.

Preferred examples of the dicarboxylic acid monomer include aliphatic dicarboxylic acids such as maleic acid, fumaric acid, citraconic acid, itaconic acid, glutaconic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid and anhydrides or lower alkyl esters of these acids. If necessary, it is also possible to use aromatic dicarboxylic acids such as phthalic acid, isophthalic acid, terephthalic acid and anhydrides or lower alkyl esters of the above-described acids.

In the present invention, the softening point, Tsp, and the glass transition point, Tg, are defined respectively as values measured by the following methods.

Softening Point, Tsp

The softening point is defined as a temperature corresponding to ½ of the height from the flow initiation point to the flow termination point in the case where a sample having an area of 1 $cm^2$ is melt-flowed under conditions of a die pore diameter of 1 mm, a pressure of 20 $kg/cm^2$ and a temperature rise rate of 6° C./min through the use of a Koka flow tester "CFT-500" (manufactured by Shimadzu Corporation).

Glass Transition Point, Tg

A sample is heated to 100° C. by means of a differential scanning calorimeter (manufactured by Seiko Instruments Inc.), maintained at that temperature for 3 min and then cooled to room temperature at a temperature reducing rate of 10° C./min. In this sample, the measurement is conducted at a temperature increase of 10° C./min to obtain a curve. The intersection of a line extending from the base line of the curve at a portion below the glass transition temperature and a tangential line having the maximum gradient between the rising portion of the peak and the vertex of the peak is determined, and the temperature at that intersection is defined as the glass transition temperature, Tg.

The developer composition of the present invention contains the above-described first polyester and the above-described second polyester as indispensable components. The first polyester and the second polyester may be previously melt-blended with each other. The developer composition further contains a colorant, and, if necessary, may contain the other additives and resins besides first and second polyesters.

Low molecular weight polyolefins can be preferably used as the other additives. Specifically, low molecular weight polyethylene and polypropylene, etc. may be preferably used, and the softening point thereof as determined by the ring-and ball method is preferably 70° to 150° C., further advantageously 120° to 150° C. The incorporation of the above-described low molecular weight polyolefin contributes to further improvement in the hot offset resistance.

Examples of the above-described colorant include carbon black, nigrosine dyes (C. I. No. 50415B), aniline blue (C. I. No. 50405), chalco oil blue (C. I. No. azoic Blue 3), chrome yellow (C. I. No. 14090), ultramarine blue (C. I. No. 77103), de Pont oil red (C. I. No. 26105), quinoline yellow (C. I. No. 47005), methylene blue chloride (C. I. No. 52015), phthalocyanine blue (C. I. No. 74160), malachite green oxalate (C. I. No. 42000), lamp black (C. I. No. 77266), rose bengal (C. I. No. 45435) and a mixture thereof. In general, the content of these colorants is preferably about 1 to 20 parts by weight based on 100 parts by weight of the toner.

The toner according to the present invention can be prepared, for example, by the following method. Specifically, a toner comprising a powder having a desired particle diameter can be prepared by adding a colorant to the mixture of the first polyester and the second polyester and optionally other resin(s), preliminarily mixing them with each other, melt-kneading the mixture and subjecting the kneaded mixture to cooling, granulation, pulverization and classification.

In the present invention, although there is no particular limitation on the particle diameter of the toner, the mean particle size is usually 3 to 30 μm.

If necessary, flow improvers, cleaning improvers, etc. may be incorporated into the toner according to the present invention. Examples of the flow improver include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. Impalpable powder of silica is particularly preferred.

The impalpable powder of silica is a fine powder of a compound having a Si-O-Si bond, and may be prepared by either the dry process or the wet process. Although the impalpable powder may contain any of aluminum silicate, sodium silicate, potassium silicate, magnesium silicate and zinc silicate as well as anhydrous silicon dioxide, the impalpable powder containing 85 to 100% by weight of $SiO_2$ is preferable. It is also possible to use an impalpable powder of silica subjected to a surface treatment with a silane coupling agent, a titanium coupling agent, a silicone oil, a silicone oil having an amino group in its side chain and the like in the present invention.

Examples of the cleaning improver include impalpable or fine powders of metal salts of higher fatty acids represented by zinc stearate and fluoropolymers.

Further, it is also possible to use additives for adjusting the developability, for example, an impalpable powder of a polymer of methyl methacrylate.

Further, a minor amount of carbon black may be used for the purpose of adjusting the color tone and resistance. Examples of the carbon black useable in the present invention include various types of carbon black known in the art, for example, furnace black, channel black and acetylene black.

When the toner according to the present invention contains a magnetic impalpable or fine powder, it may be used alone as a developer. On the other hand, when it contains no magnetic impalpable powder, it may be used in the form of a binary developer prepared by mixing it with a carrier. There is no particular limitation on the carrier, and examples thereof include iron powder, ferrite and glass beads or the above-described carriers coated with a resin. The mixing ratio of the toner to the carrier is 0.5 to 10% by weight. The particle diameter of the carrier is 30 to 500 μm. It is also possible to use a nonmagnetic one-component toner without the use of a carrier.

Since the developer composition of the present invention comprises first and second polyesters, each having particular properties, it is excellent in hot offset resistance, low temperature fixation, smoothness and transparency of the fixed face and blocking resistance by virtue of a synergistic effect of these first and second polyesters.

Specifically, the first polyester is a linear polyester and has a relatively high molecular weight. The first polyester, as such, is excellent in hot offset resistance and blocking resistance as well as in the dispersibility of the additives contained therein, so that it can impart excellent transparency to the toner. However, it caused deterioration in the surface smoothness in the low temperature fixation region. On the other hand, the second polyester is a linear polyester having a relatively low molecular weight. As such, it imparts excellent low temperature fixation, smoothness of the fixed face and transparency to the toner. However, it causes deterioration in the hot offset resistance and blocking resistance. Therefore, when the first polyester and the second polyester are used alone, the respective drawbacks are remarkably exhibited. However, in the developer composition of the present invention, since both the first polyester and the second polyester are present together, the mixture contains the so-called "linearly broadened molecular weight distribution". As a result, to the toner according to the present invention, excellent transparency is imparted by virtue of the presence of the first polyester having a relatively high molecular weight which is excellent in hot offset resistance and blocking resistance as well as in the dispersibility of additives dispersed therein. At the same time, excellent low temperature fixation, smoothness of the fixed face and transparency are imparted by virtue of the presence of the second polyester having a low molecular weight, so that it is possible to attain excellent results whereby low temperature fixation and the smoothness of the fixed face can be significantly improved without adversely affecting the hot offset resistance, blocking resistance and transparency, and furthermore, a toner having excellent properties can be efficiently prepared by the conventional kneading-pulverization process.

EXAMPLES

The present invention will now be described in more detail with reference to the following Examples which should not be considered to limit the scope of the present invention.

Production of Polyester

A four neck flask having a capacity of 2 liters and equipped with a thermometer, a stainless steel agitator, a glass nitrogen inlet tube and a falling condenser was charged with components according to the formulation indicated in Table 1 with the further addition of 0.75 g of hydroquinone, and then set in a mantle heater. The contents of the flask were allowed to react with each other at 220° C. and below in a nitrogen atmosphere and under reduced pressure with agitation. The progress of the reaction was monitored by measuring the acid value and the reaction was stopped when the acid value reached a predetermined value. The flask was then cooled to room temperature to produce individual polyesters as a yellow solid form.

The property values of the respective polyesters are given in Table 1.

TABLE 1

| | Monomer for Alcohol Component | | Monomer for Acid component | | | Properties of resin | |
|---|---|---|---|---|---|---|---|
| Polyester No. | polyoxypropylene (2.2)-2,2-bis(4-hydroxyphenyl) propane | polyoxy-ethylene(2.0)-2,2-bis(4-hydroxyphenyl) propane | fumaric acid | succinic acid | isophthalic acid | softening point Tsp | glass transition point Tg |
| 1a | 1050 (3.0 mol) | — | 348 (3.0 mol) | — | — | 90° C. | 54° C. |
| 1b | 1050 (3.0 mol) | — | 348 (3.0 mol) | — | — | 97 | 58 |
| 1c | 1050 (3.0 mol) | — | 348 (3.0 mol) | — | — | 102 | 61 |
| 1d | 1050 (3.0 mol) | — | 348 (3.0 mol) | — | — | 112 | 64 |
| 1e | 1050 (3.0 mol) | — | 348 (3.0 mol) | — | — | 123 | 67 |
| 2a | 1050 | — | — | 354 g (3.0 mol) | — | 92 | 53 |
| 2b | 1050 (3.0 mol) | — | — | 354 g (3.0 mol) | — | 112 | 64 |

TABLE 1-continued

| Polyester No. | Monomer for Alcohol Component: polyoxypropylene (2.2)-2,2-bis(4-hydroxyphenyl) propane | Monomer for Alcohol Component: polyoxyethylene(2.0)-2,2-bis(4-hydroxyphenyl) propane | Monomer for Acid component: fumaric acid | Monomer for Acid component: succinic acid | Monomer for Acid component: isophthalic acid | Properties of resin: softening point Tsp | Properties of resin: glass transition point Tg |
|---|---|---|---|---|---|---|---|
| 2c | 1050 (3.0 mol) | — | — | 354 g (3.0 mol) | — | 122 | 67 |
| 3a | 840 (2.4 mol) | 195 (0.6 mol) | 244 (2.1 mol) | — | 149 (0.9 mol) | 89 | 52 |
| 3b | 840 (2.4 mol) | 195 (0.6 mol) | 244 (2.1 mol) | — | 149 (0.9 mol) | 113 | 63 |
| 3c | 840 (2.4 mol) | 195 (0.6 mol) | 244 (2.1 mol) | — | 149 (0.9 mol) | 118 | 65 |

EXAMPLES 1 TO 6 AND COMPARATIVE EXAMPLES 5 TO 5

In the individual Examples and Comparative Examples, 80 parts by weight in total of the polyesters in combination and blended in the amount indicated in Table 2, 20 parts by weight of styrene-acrylic resin, 1 part by weight of a magenta dye "ROB-B" (manufactured by Orient Chemical Industries, Ltd.), 0.8 part by weight of a charge control agent "Bontron P-51" (manufactured by Orient Chemical Industries, Ltd.) and 2 parts by weight of a low molecular weight polypropylene "Viscol 660P" (softening point, Tsp, 130° C.; a product of Sanyo Chemical Industries, Ltd.) were preliminarily mixed with each other. Then the resulting mixture was subjected to conventional procedures, i.e., melting, kneading, cooling, grinding and classification, to prepare a particulate powder having a particle diameter of 10 μm.

In the step of grinding, the mass, after kneading, was crushed and classified to pass a 9.2 mesh (nominal size: 2 mm)/16 mesh on (nominal size: 1 mm) and finely ground by means of a jet fine grinding mill. 0.3 part by weight of an impalpable powder of hydrophobic silica "Aerosil R-972" was added and mixed with 100 parts by weight of the particulate powder to give a toner according to the present invention.

50 parts by weight of the toner thus obtained was mixed with 950 parts by weight of silicone-coated ferrite carrier (manufactured by Kanto Denka Kogyo Co., Ltd.) by means of a V-shape blender to give a developer.

This developer was used in a two-component dry copying machine equipped with a commercially available organic photoreceptor to obtain an initial image and subjected to a performance evaluation according to the following methods.

Evaluation Methods

(1) Minimum Fixation Temperature

An unfixed image was formed within a copying machine, and a test was conducted on a fixation temperature region by means of an external fixing machine. In the fixing roller of the external fixing machine, both upper and lower rollers were coated with a high heat resistant silicone rubber, and a heater was provided within the upper roller.

Toner images formed by the above-described individual toners transferred on a transfer paper having a basis weight of 64 g/m$^2$ under environmental conditions of a temperature of 20° C. and a relative humidity of 20% were fixed at a linear velocity of 115 mm/sec by means of a heat roller fixing apparatus which was conducted by the stepwise raising of the set temperature of the heat roller from 120° C.

In the resultant fixed image, a solid toner having a size of 2 cm×2 cm was folded in two, and the folded portion was inspected with the naked eye to determine the toner was fixed or not. The minimum preset temperature necessary for obtaining a fixed image was determined. This temperature was viewed as the minimum fixing temperature. The heat roller fixing apparatus is one not equipped with a silicone oil feed mechanism.

(2) Hot Offset Generation Temperature

According to the above-described measurement of the minimum fixing temperature, a toner image was transferred, a fixation treatment was conducted by means of the above-described heat roller fixing apparatus, and a transfer paper having a white color was fed to the above-described heat roller fixing apparatus under the same conditions to determine with the naked eye whether or not toner staining occurred. The above-described procedure was repeated in such a manner that the preset temperature of the heat roller of the above-described heat roller fixing apparatus was successively raised, thereby determining the minimum preset temperature at which the toner staining occurred. The minimum present temperature was viewed as the hot offset generation temperature.

(3) Gloss of Fixed Face

At a coverage of 15 mg/cm$^2$ of the toner on the paper, the gloss of the toner image which formed by fixing at each fixing temperature was measured through the use of a glossmeter "MODEL VG-2PD" manufactured by Nippon Denshoku Co., Ltd..

(4) Transparency

The transparency of sheet copy for OHP was compared with the color reproducibility of an image projected by OHP. The transparency is measured through the use of SZ-Σ80 manufactured by Nippon Denshoku Co., Ltd.. In this case, the transmittance of a wavelength region of visible light was measured with the transparency of an unused sheet for OHP being supposed to be 100%.

The results are summarized in Table 2.

TABLE 2

| | Toner No. | First polyester No. | First polyester softening point Tsp | First polyester amt. of blending | Second polyester No. | Second polyester softening point Tsp | Second polyester amt. of blending | Offset generation temp. | Min. fixation temp. | Gloss 160° C. | Gloss 180° C. | Transparency (OHP film) spectral trans-mittance | Transparency (OHP film) color reproduci-bility |
|---|---|---|---|---|---|---|---|---|---|---|---|---|---|
| Ex. 1 | toner 1 | 1d | 112° C. | 50 pts. wt | 1a | 90° C. | 50 pts. wt | 200° C. | 150° C. | 8 | 20 | 85% | bright magenta |
| Ex. 2 | toner 2 | 1e | 123 | 30 | 1a | 90 | 70 | 190 | 160 | 7 | 18 | 82 | bright magenta |
| Ex. 3 | toner 3 | 2b | 112 | 50 | 2a | 92 | 50 | 200 | 150 | 7 | 19 | 83 | bright magenta |
| Ex. 4 | toner 4 | 2c | 122 | 30 | 2a | 92 | 70 | 200 | 160 | 6 | 18 | 81 | bright magenta |
| Ex. 5 | toner 5 | 3b | 113 | 50 | 3a | 89 | 50 | 190 | 150 | 8 | 16 | 81 | bright magenta |
| Ex. 6 | toner 6 | 3c | 118 | 30 | 3a | 89 | 70 | 190 | 150 | 7 | 15 | 80 | bright magenta |
| Comp. Ex. 1 | comp. toner 1 | 1b | 97° C. | 50 pts. wt | 1a | 90 | 50 pts. wt | 160 | 150 | — | — | — | — |
| Comp. Ex. 2 | comp. toner 2 | 1e | 123 | 30 | 1d | 112 | 70 | 210 | 170 | — | 6 | 72 | dark magenta |
| Comp. Ex. 3 | comp. toner 3 | 1d | 112 | 100 | — | — | — | 210 | 170 | — | 7 | 74 | dark magenta |
| Comp. Ex. 4 | comp. toner 4 | — | — | — | 2a | 92 | 100 | 150 | 140 | — | — | — | — |
| Comp. Ex. 5 | comp. toner 5 | 1c | 102 | 50 | 1b | 97 | 50 | 170 | 150 | 15 | — | — | — |

Further, the above-described toners 1 to 6 were allowed to stand under environmental conditions at a temperature of 45° C. and a relative humidity of 26% for 2 weeks, and the blocking resistance was evaluated based on whether or not agglomeration occurs in each toner. As a result, no agglomerate was observed, and the blocking resistance was excellent.

As can be understood from the above-described results, all the toners 1 to 6 of the present invention were excellent in hot offset resistance, low temperature fixation, gloss of fixed face, transparency and blocking resistance, and it is possible to prepare a toner which is excellent particularly in its heat characteristics.

By contrast, the comparative toner 1 is poor in hot offset resistance because the softening point, Tsp, of the first polyester is below 105° C.

The comparative toner 2 is poor in low temperature fixation, gloss of fixed surface and transparency because the softening point, Tsp, of the second polyester is not below 105° C.

The comparative toner 3 is poor in low temperature fixation, gloss and transparency because it contains no second polyester.

The comparative toner 4 is poor in hot offset resistance because it contains no first polyester.

The comparative toner 5 is poor in hot offset resistance because the difference in the softening point, Tsp, between the first polyester and the second polyester is less than 10° C.

The invention being thus described, it will be obvious that the same may be varied in many ways. Such variations are not to be regarded as a departure from the spirit and acope of the invention, and all such modifications as would be obvious to one skilled in the art are intended to be included within the scope of the following claims.

What we claim:

1. A developer composition for electrophotography comprising a binding resin and a colorant, said binding resin comprising a first linear polyester having a softening point, Tsp, in the range of from 105° C. to 170° C. exclusive, and a second linear polyester having a softening point, Tsp, in the range of from 80° C. to 105° C. exclusive and lower than that of the first linear polyester by at least 10° C., the weight ratio of the first linear polyester to the second linear polyester being (80:20) to (20:80).

2. The developer composition for electrophotography according to claim 1, wherein the first linear polyester and the second linear polyester each comprises an acid component originated from an aliphatic dicarboxylic acid and/or acid anhydride thereof in an amount of 50% and more by mole based on the entire acid component.

3. The developer composition for electrophotography according to claim 1, wherein the first linear polyester and the second linear polyester each comprises an alcohol component originated from a compound represented by the following general formula (1) as a main component of its alcohol component:

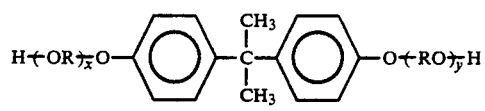

(1)

wherein R stands for an ethylene group or a propylene group and x and y are each an integer, provided that the average value of the sum of x and y values is 2 to 7.

4. The developer composition for electrophotography according to claim 1, wherein the glass transition temperatures of the first linear polyester and the second linear polyester are 40° to 80° C.

5. The developer composition for electrophotography according to claim 1, wherein the binding resin comprises 70 to 100% by weight of the total amount of the first linear polyester and the second linear polyester, based on the entire binding resin.

6. The developer composition for electrophotography according to claim 1, wherein the binding resin comprises 70 to 100% by weight of the total amount of the first linear polyester and the second linear polyester and 30 to 0% by weight of styrene-acrylic resin based on the entire binding resin.

7. The developer composition for electrophotography according to claim 1, wherein the developer composition further comprises a low molecular weight polyolefin.

8. The developer composition for electrophotography according to claim 1, wherein the developer composition further comprises a magnetic impalpable powder.

* * * * *